US005960572A

United States Patent [19]

DeVito

[11] Patent Number: 5,960,572

[45] Date of Patent: Oct. 5, 1999

[54] TOLL PASS HOLDER

[76] Inventor: Joseph A DeVito, 2141 Willow St., Wantagh, N.Y. 11791

[21] Appl. No.: 08/967,997

[22] Filed: Nov. 12, 1997

[51] Int. Cl.[6] ..... G09F 21/04

[52] U.S. Cl. ..... 40/593; 40/591; 40/597; 40/643; 40/649; 248/260.2; 248/206.3

[58] Field of Search ..... 40/591, 593, 597, 40/611, 757, 765, 643, 649; 248/205.5, 206.2, 206.3, 314, 316.2, 231.81, 363

[56] References Cited

U.S. PATENT DOCUMENTS

| | | | |
|---|---|---|---|
| 1,728,741 | 9/1929 | Wykes, Jr. | 40/649 |
| 3,213,556 | 10/1965 | Cobbs | 40/649 |
| 3,313,053 | 4/1967 | Vogeli, Sr. | 40/643 |
| 3,531,880 | 10/1970 | Ramee | 40/593 X |
| 3,533,178 | 10/1970 | Strohmaier | 40/593 X |
| 4,171,584 | 10/1979 | Kaiser | 40/597 X |
| 4,184,276 | 1/1980 | Hernandez . | |
| 4,470,214 | 9/1984 | Kinloch | 40/593 |
| 4,836,482 | 6/1989 | Sokol | 248/206.3 |
| 4,951,909 | 8/1990 | Russo et al. | 248/206.2 |
| 5,069,376 | 12/1991 | Barel . | |
| 5,131,177 | 7/1992 | Sy, Jr. . | |
| 5,241,768 | 9/1993 | Thompson . | |
| 5,423,140 | 6/1995 | Nuspl | 40/597 X |
| 5,479,735 | 1/1996 | Martin, Jr. | 40/593 |
| 5,502,912 | 4/1996 | LeBoff et al. . | |
| 5,522,163 | 6/1996 | Neugebauer . | |
| 5,566,030 | 10/1996 | Yue | 40/593 X |
| 5,592,767 | 1/1997 | Treske | 40/649 |
| 5,636,462 | 6/1997 | Kleiman | 40/591 X |
| 5,692,331 | 12/1997 | Tipke | 40/591 |
| 5,740,624 | 4/1998 | Baseley | 40/649 |
| 5,822,900 | 10/1998 | Armstrong | 40/593 X |

FOREIGN PATENT DOCUMENTS

| | | | |
|---|---|---|---|
| 2650104 | 1/1991 | France | 40/593 |

*Primary Examiner*—Brian K. Green
*Assistant Examiner*—Robert G. Santos
*Attorney, Agent, or Firm*—Michael I. Kroll

[57] ABSTRACT

A toll pass holder (10) comprising a housing (12) having an open top compartment (14) with a large open from window (16), so as to receive an electronic toll pass (18) inserted therein. A structure (20) is for temporarily retaining the housing (12) to an interior surface (22) of a windshield (24) in a motor vehicle (26). The large open front window (16) in the housing (12) faces the interior surface (22) of the windshield (24), so that the electronic toll pass (18) can operate therefrom.

8 Claims, 6 Drawing Sheets

TOLL PASS HOLDER

BACKGROUND OF THE INVENTION

1. Field of the Invention

The instant invention relates generally to holders and more specifically it relates to a toll pass holder. The toll pass holder consists of an adjustable hinged housing for an electronic toll pass in combination with suction cups to retain it in a removable manner to an interior surface of a windshield above a rear view mirror in a motor vehicle.

2. Description of the Prior Art

Numerous holders have been provided in prior art For example, U.S. Pat. No. 4,184,276 to Hernandez; U.S. Pat. No. 5,069,376 to Barel; U.S. Pat. No. 5,131,177 to Sy, Jr.; U.S. Pat. No. 5,241,768 to Thompson; U.S. Pat. No. 5,502,912 to LeBoff et al. and U.S. Pat. No. 5,522,163 to Neugebauer all are illustrative of such prior art. While these units may be suitable for the particular purpose to which they address, they would not be as suitable for the purposes of the present invention as heretofore described.

HERNANDEZ, ALBERT

MOTOR VEHICLE REGISTRATION CARD HOLDER

U.S. Pat. No. 4,184,276

A U-shaped holder made of a light flexible material having grooves in the inside walls and bottom thereof forming a slot to receive an automobile registration card or plate. Affixed to one face of the holder is a layer of flexible material coated with a pressure sensitive adhesive to facilitate securing the holder to the windshield of an automobile.

BAREL, MEIR

MOTOR VEHICLE ACCESSORY PARTICULARLY USEFUL FOR HOLDING A SIGN OR OTHER ARTICLE

U.S. Pat. No. 5,069,376

A motor vehicle accessory particularly useful for holding a sign or other article, includes a plate member formed at one end with a mounting section for insertion between the vehicle windshield and the vehicle dashboard. The mounting section extends obliquely to the plate member, and is joined to it by an elastic juncture section, such that when the mounting section is inserted between the vehicle windshield and the vehicle dashboard, the plate member is pressed towards the inner surface of the windshield to thereby releasably hold a sign or other article between it and the inner surface of the windshield.

SY, JR., ENRIQUE M.

APPARATUS FOR DISPLAYING A STICKER ON ANY SELECTED SURFACE THAT IS REMOVABLE FROM THAT SURFACE WITHOUT DAMAGE THERETO

U.S. Pat. No. 5,131,177

A portable and reversible lightweight sticker display system is disclosed for stickers and the like. Each of the various embodiments includes a display board of various configurations each defining slots for capturing a support device along each side edge, and stiffening rods for high temperature and windy applications. In each embodiment the mounting devices can be reversed so that the display board can be mounted on the inside of a window, so that the sticker is visible through the window or on the outside of a surface. Simply reverse the position of the display board and the suction cups to display a sticker on the other side of the display board. The sticker display system can also be utilized as a sun visor to cover the open area of the windshield of an automobile.

THOMPSON, JAMES A.

MESSAGE HOLDER

U.S. Pat. No. 5,241,768

A message holder for use in vehicles or home or other building windows or the like provides for the display of a message inserted therein. The holder is formed of at least one sheet of transparent material and contains a central space in which a message, such as a bumper sticker, may be temporarily installed for display. Suspension rods are pivotally attached to opposite ends of the holder and have suction cups to provide for the attachment of the holder to any suitable surface. The suspension rods may be locked at any desired angle in order to allow a message displayed within the holder to be seen clearly even through a sloped window, as in the rear window of many vehicles. The holder provides for the temporary display of a bumper sticker or other message as desired without the need to adhesively secure the sticker to a surface and the resulting difficulty of subsequent removal and possible marring of the finish. An alternative version includes suction cups on attachment lugs extending from each end of the holder.

LeBOFF, ANDREW

RINGEL, JOHN

DISPLAY HOLDER FOR A PICTURE, CERTIFICATE, LICENSE INSPECTION STICKER, REGISTRATION STICKER AND THE LIKE

U.S. Pat. No. 5,502,912

A display holder for a registration sticker, inspection sticker, certificate, license, and photograph and the like is provided, which consists of a structure for protecting the display item while allowing viewing thereof. A fastener is for securing the protecting structure to a flat surface, so that a person can view the display item therefrom.

NEUGEBAUER, EDWARD J.

CARD HOLDER

U.S. Pat. No. 5,522,163

A card holder for displaying a card including a transparent base with a wall having a slot therein, a transparent cover having a flange extending therefrom, and a threaded fastener. The flange on the cover engages the slot in the wall. The threaded fastener engages apertures in both the base and cover to secure the card holder in a closed position.

SUMMARY OF THE INVENTION

A primary object of the present invention is to provide a toll pass holder that will overcome the shortcomings of the prior art devices.

Another object is to provide a toll pass holder having an adjustable hinged housing for an electronic toll pass in combination with suction cups for retaining it in a removable manner to an interior surface of a windshield above a rear view mirror in a motor vehicle.

An additional object is to provide a toll pass holder in which the housing has an open top compartment with a large open window and a pair of side leaf springs to keep the electronic toll pass secure and operable therein.

A still additional object is to provide a toll pass holder in which the housing has a pressure clip mounted in a rotatable manner to a rear surface behind the open top compartment, for retaining such items as a license, registration, toll tickets, toll receipts, paper money and parking garage receipts.

A further object is to provide a toll pass holder that is simple and easy to use.

A still further object is to provide a toll pass holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
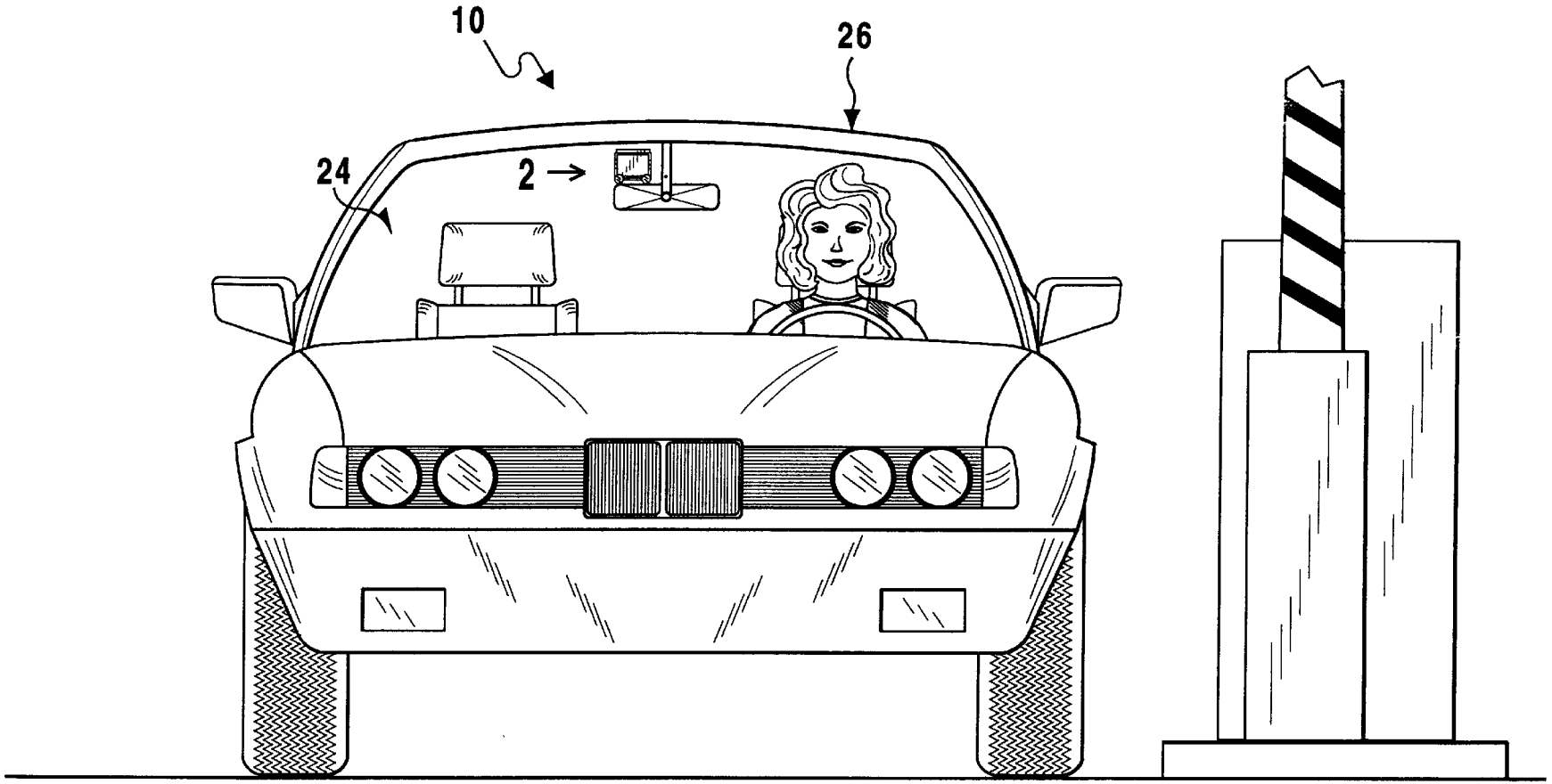
FIG. 1 is a front elevational view of a motor vehicle at a toll plaza, showing the present invention installed in place on the windshield.

Turning now descriptively to the drawings, in which similar reference characters denote similar elements throughout the several views, FIGS. 1 through 6 illustrate the present invention being a toll pass holder 10. With regard to the reference numerals used, the following numbering is used throughout the various drawing figures.

| | |
|---|---|
| 10 | toll pass holder |
| 12 | housing of 10 |
| 14 | open top compartment in 12 |
| 16 | large open front window in 12 |
| 18 | electronic toll pass |
| 20 | temporarily retaining structure of 10 |
| 22 | interior surface of 24 |
| 24 | windshield in 26 |
| 26 | motor vehicle |
| 28 | suction cup of 20 |
| 29 | front surface of 12 |
| 30 | angularly adjusting facility of 10 |
| 32 | base portion of 28 |
| 34 | shaft portion of 28 |
| 36 | cup portion of 28 |
| 38 | recessed area in 12 of 30 |
| 40 | pivoting assembly of 30 |
| 42 | longitudinal bore in 12 between 38 |
| 44 | transverse cylindrical hole in first 32 |
| 46 | transverse threaded cylindrical aperture in second 32 |
| 48 | bolt of 40 |
| 50 | elongated shank of 48 |
| 52 | threaded distal end on 50 |
| 54 | keeping assemblage of 10 |
| 56 | top portion of 18 |
| 58 | leaf spring of 54 |
| 60 | holding facility of 54 |
| 62 | upper slot of 60 |
| 64 | lower slot of 60 |
| 66 | pressure clip |
| 67 | fastener |
| 68 | rear surface of 12 |
| 70 | additional item in 66 |

The toll pass holder 10 comprises a housing 12 having an open top compartment 14 with a large open front window 16, so as to receive an electronic toll pass 18 inserted therein. A structure 20 is for temporarily retaining the housing 12 to an interior surface 22 of a windshield 24 in a motor vehicle 26. The large open front window 16 in the housing 12 faces the interior surface 22 of windshield 24, so that the electronic toll pass 18 can operate therefrom.

The temporarily retaining structure 20 includes a pair of suction cups 28. Each suction cup 28 extends outwardly from a front surface 29 and adjacent a corner at a bottom end of the housing 12 below the large open front window 16.

A facility 30 is for angularly adjusting both of the suction cups 28 on the housing 12. When the suction cups 28 are temporarily retained to the interior surface 22 of the windshield 24, the housing 12 can swing down to a generally horizontal position, to allow the electronic toll pass 18 to be inserted and removed from the open top compartment 14. The housing 12 can swing up to a generally vertical position parallel to the windshield 24, to allow the electronic toll pass 18 to operate therefrom. Each suction cup 28 consists of a base portion 32 with a shaft portion 34 extending from the base portion 32. A cup portion 36 is formed on an end of the shaft portion 34 opposite from the base portion 32. The cup portion 36, when pressed against the interior surface 22 of the windshield 24, will temporarily stick thereto.

The angularly adjusting facility 30 comprises the housing 12 having a recessed area 38 at each corner at the bottom end of the housing 12 at the front surface below the large open front window 16. Each base portion 32 of the suction cups 28 can fit into each recessed area 38. An assembly 40 is for pivoting the base portions 32 of the suction cups 28 within the recessed areas 38 in the housing 12.

Figure 6:
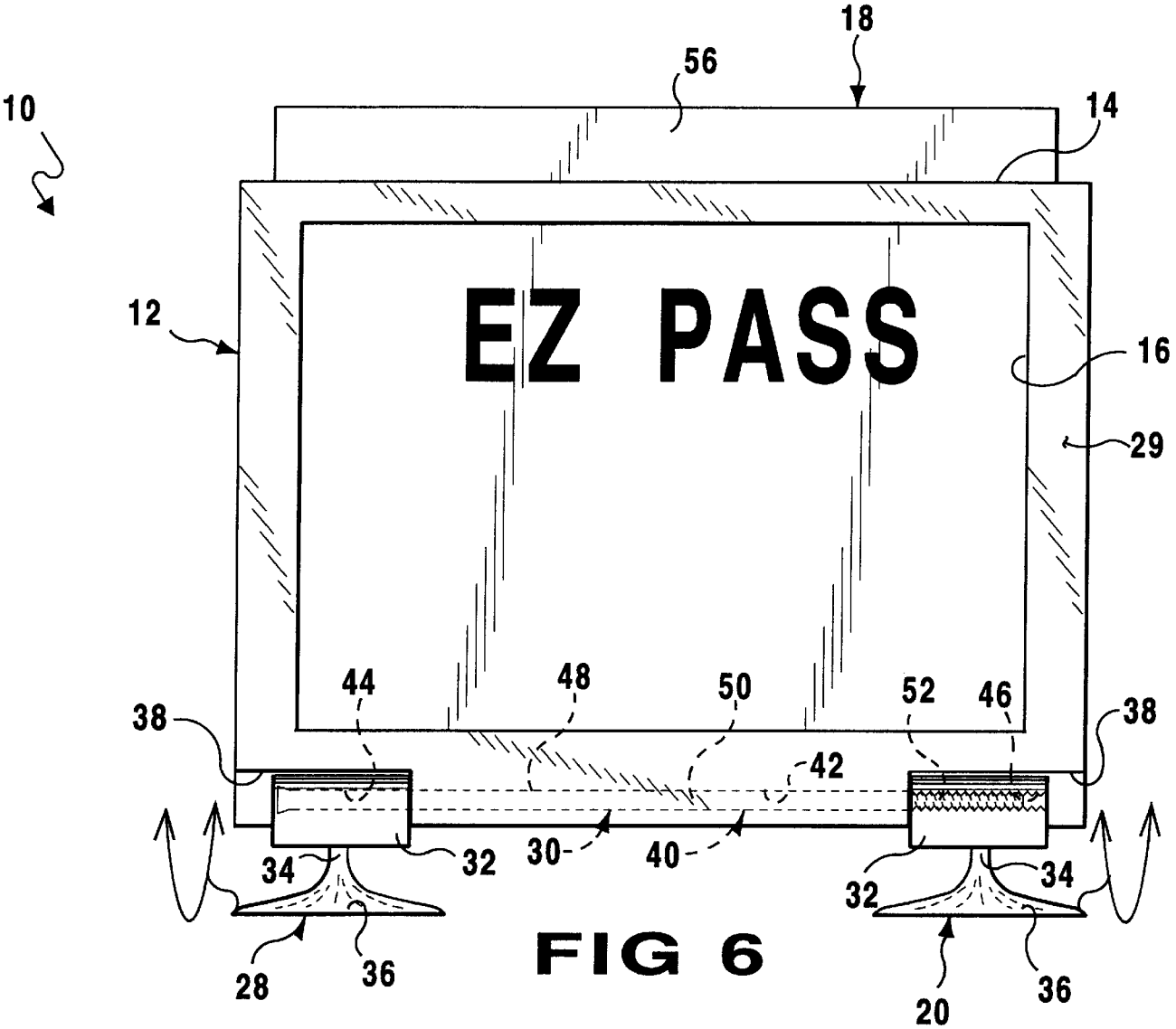
FIG. 6 is a front elevational view similar to FIG. 3, showing the suction cups in a downward vertical position and a bolt in phantom threaded on one end, that will enable a person to tighten and loosen the bolt, to change resistance of movement between the suction cups and the housing.

The pivoting assembly 40, as best seen in FIG. 6, consists of the housing 12 having a longitudinal bore 42 extending between the recessed areas 38 at the bottom end. The first base portion 32 of the first suction cup 28 has a transverse cylindrical hole 44 therethrough. The second base portion 32 of the second suction cup 28 has a transverse threaded cylindrical aperture 46 therethrough. A bolt 48 has an elongated shank 50 with a threaded distal end 52. The elongated shank 50 is inserted through the transverse cylindrical hole 44 in the first base portion 32, through the longitudinal bore 42 in the housing 12, with the threaded distal end 52 threaded into the transverse threaded cylindrical aperture 46 in the second base portion 32. The bolt 48 can be tightened and loosened to change resistance of movement between the suction cups 28 and the housing 12.

Figure 5:
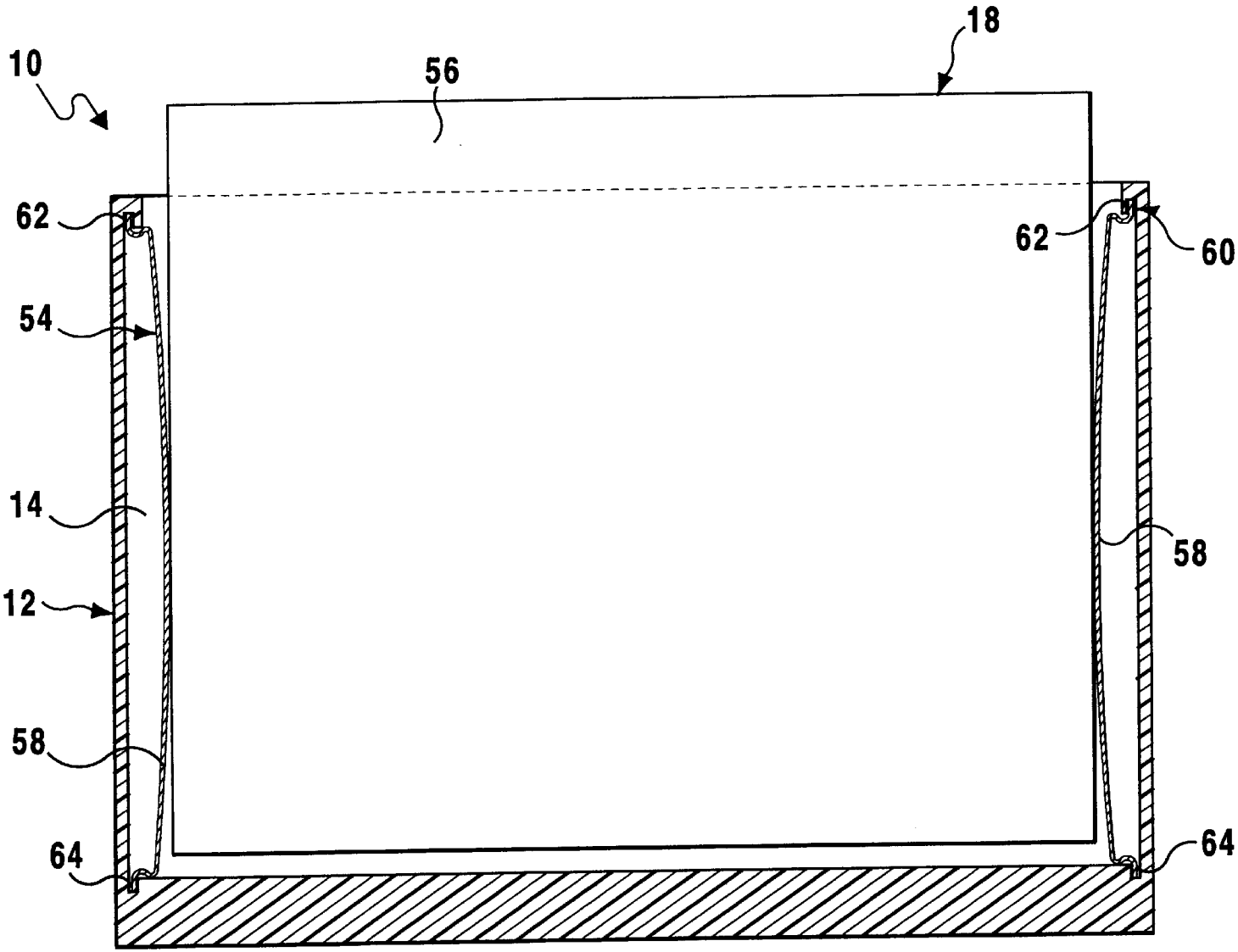
FIG. 5 is a cross sectional view taken along line 5—5 in FIG. 2, showing the pair of leaf springs in the open top compartment keeping the electronic toll pass secure in the housing.

The toll pass holder 10 further includes an assemblage 54, for keeping the electronic toll pass 18 in a secured manner within the open top compartment 14, with a top portion 56 of the electronic toll pass 18 extending outwardly, to be grasped by a hand of a person, so that it can be inserted and removed therefrom. The keeping assemblage 54, as shown in FIG. 5, contains a pair of leaf springs 58. A facility 60 is for holding each leaf spring 58 within the open top compartment 14 in the housing 12 at one side thereof. The holding facility 60 includes the open top compartment 14 in the housing 12 having upper and lower slots 62 and 64 at each side thereof. The upper and lower slots 62 and 64 will engage with upper and lower ends of the leaf springs 58.

Figure 2:
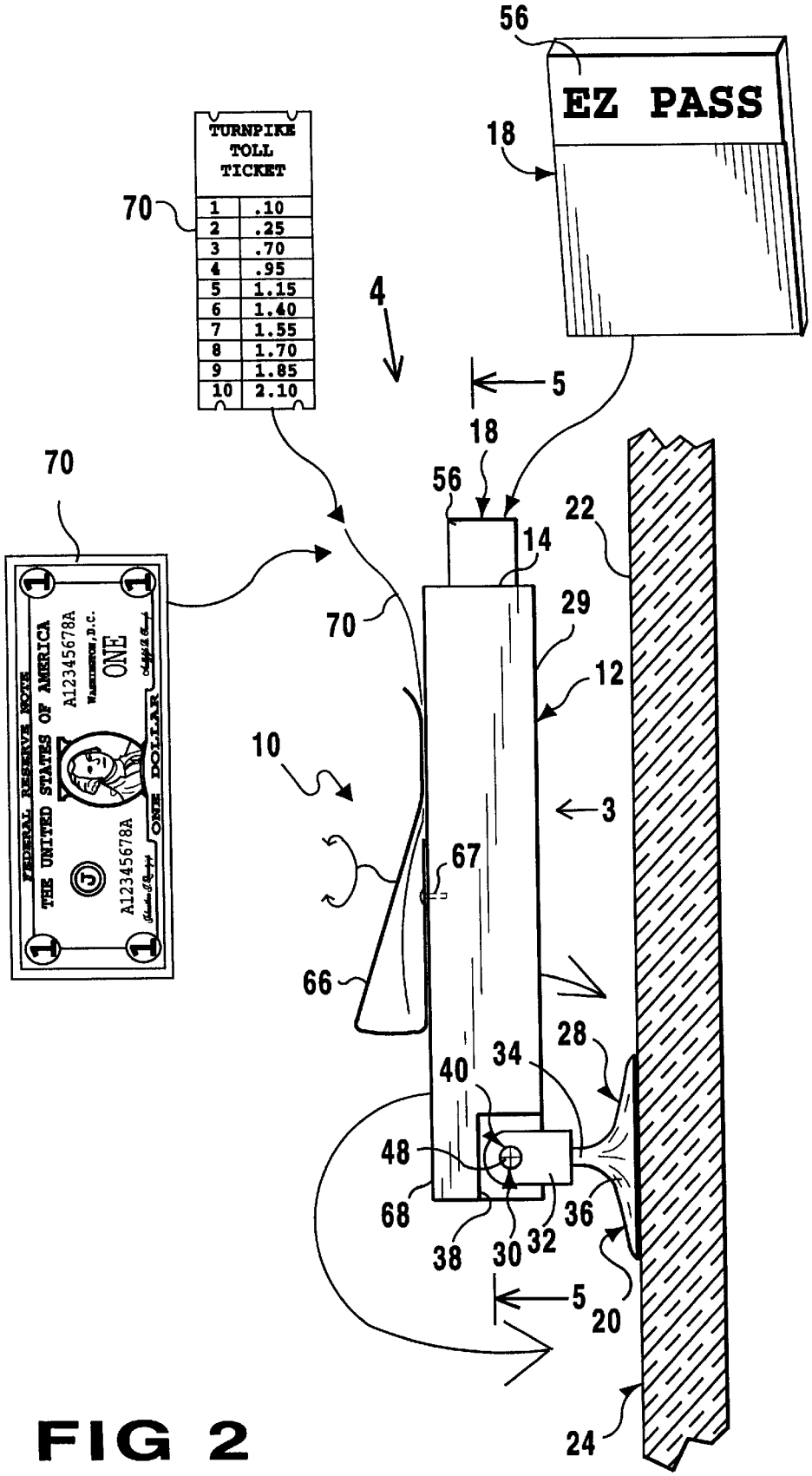
FIG. 2 is an enlarged side elevational view taken in the direction of arrow 2 in FIG. 1, with the windshield shown in cross section and a pressure clip mounted in a rotatable manner to a rear surface of the housing.
Figure 3:
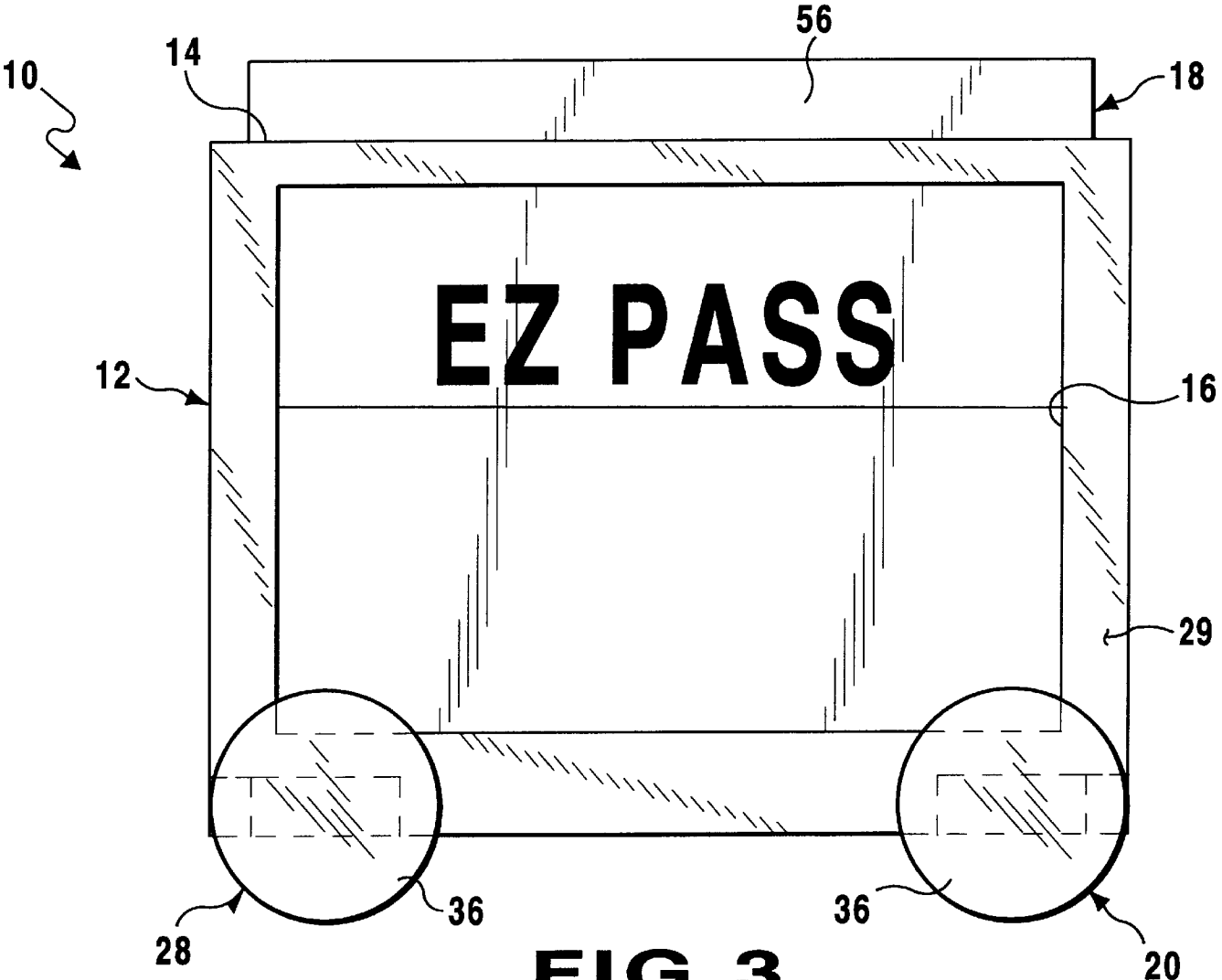
FIG. 3 is a front elevational view of the present invention per se, taken in the direction of arrow 3 in FIG. 2.
Figure 4:
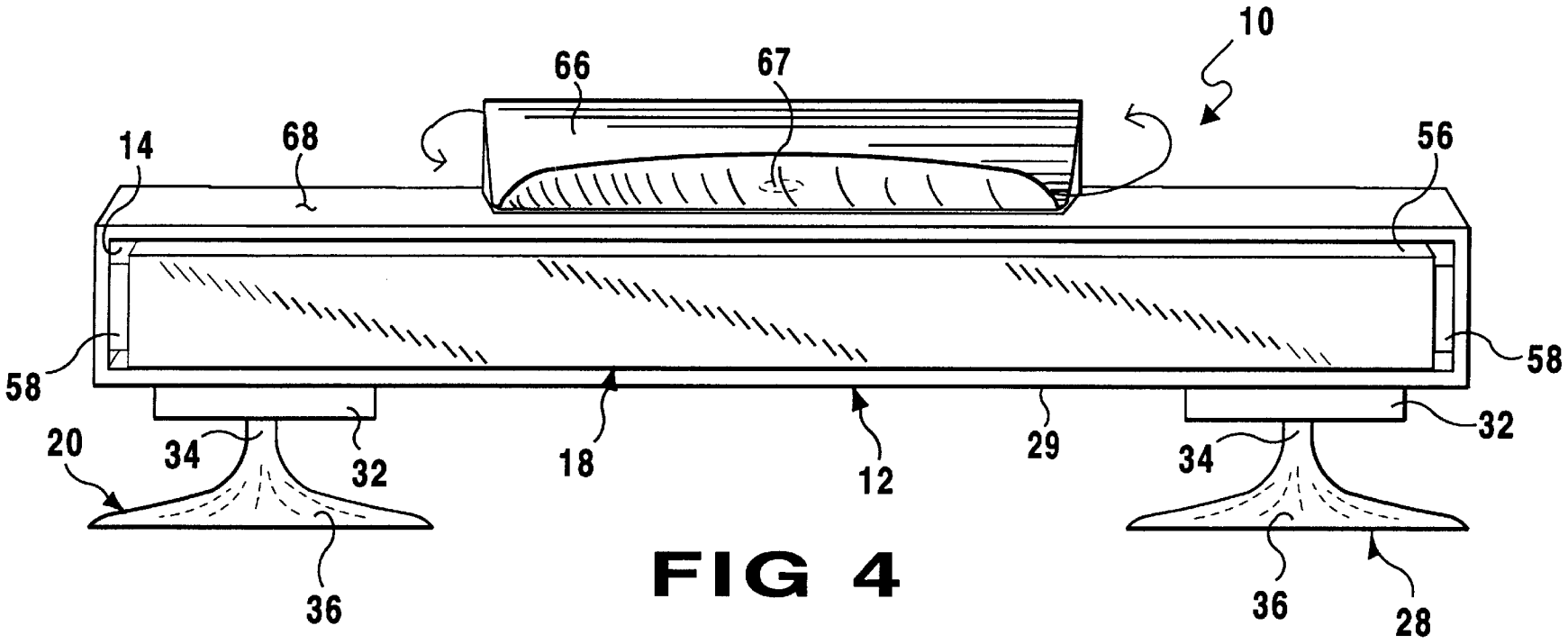
FIG. 4 is a further enlarged top perspective view taken in the direction of arrow 4 in FIG. 2, with the windshield removed therefrom.

The toll pass holder 10 further contains a pressure clip 66. A fastener 67 mounts the pressure clip 66 in a rotatable manner to a rear surface 68 of the housing 12 behind the open top compartment 14 with the large open front window 16. The pressure clip 66, as shown in FIG. 2, can receive various additional items 70, such as a license, registration, toll tickets, toll receipts, paper money and parking garage receipts. The electronic toll pass 18 in the open top compartment 14 can be an E-Z pass tag or the like.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A toll pass holder for selectively securing a toll pass to a windshield comprising:

a) a housing having an open top compartment with a large open front window, so as to receive an electronic toll pass inserted therein; and b) means for temporarily retaining said housing to an interior surface of the windshield in a motor vehicle, such that said large open front window in said housing faces the interior surface of the windshield, so that the electronic toll pass can operate therefrom; and further including:

c) means for keeping the electronic toll pass in a secured manner within said open top compartment with a top portion of the electronic toll pass extending outwardly so that it can be inserted and removed therefrom, said keeping means including:

i) a pair of leaf springs; and ii) means for holding each said leaf spring within said open top compartment in said housing at one side thereof, wherein said holding means includes said open top compartment in said housing having upper and lower slots at each side thereof, so that said upper and lower slots will engage with upper and lower ends of said leaf springs.

2. A toll pass holder as recited in claim 1, wherein said temporarily retaining means includes a pair of suction cups, each said suction cup extends outwardly from a front surface and adjacent a corner at a bottom end of said housing below said large open front window.

3. A toll pass holder as recited in claim 2, further including means for angularly adjusting both of said suction cups on said housing, so that when said suction cups are temporarily retained to the interior surface of the windshield, said housing can swing down to a generally horizontal position, to allow the electronic toll pass to be inserted and removed from said open top compartment, and said housing can swing up to a generally vertical position parallel to the windshield, to allow the electronic toll pass to operate therefrom.

4. A toll pass holder as recited in claim 3, wherein each said suction cup includes:

a) a base portion;

b) a shaft portion extending from said base portion; and c) a cup portion formed on an end of said shaft portion opposite from said base portion, wherein said cup portion when pressed against the interior surface of the windshield will temporarily stick thereto.

5. A toll pass holder as recited in claim 4, wherein said angularly adjusting means includes:

a) said housing having a recessed area at each said corner at said bottom end of said housing at said front surface below said large open front window, so that each said base portion of said suction cups can fit into each said recessed area; and b) means for pivoting said base portions of said suction cups within said recessed areas in said housing.

6. A toll pass holder as recited in claim 5, wherein said pivoting means includes:

a) said housing having a longitudinal bore extending between said recessed areas at said bottom end;

b) said first base portion of said first suction cup having a transverse cylindrical hole therethrough;

c) said second base portion of said second suction cup having a transverse threaded cylindrical aperture therethrough; and d) a bolt having an elongated shank with a threaded distal end, wherein said elongated shank is inserted through said transverse cylindrical hole in said first base portion, through said longitudinal bore in said housing, with said threaded distal end threaded into said transverse threaded cylindrical aperture in said second base portion, so that said bolt can be tightened and loosened to change resistance of movement between said suction cups and said housing.

7. A toll pass holder as recited in claim 1, further including:

a) a pressure clip; and b) a fastener to mount said pressure clip in a rotatable manner to a rear surface of said housing behind said open top compartment with said large open front window, wherein said pressure clip can receive various additional items.

8. A toll pass holder as recited in claim 6, further including:

a) a pressure clip; and b) a fastener to mount said pressure clip in a rotatable manner to a rear surface of said housing behind said open top compartment with said large open front window, wherein said pressure clip can receive various additional items.

* * * * *